US006486111B1

(12) United States Patent
Zabarylo et al.

(10) Patent No.: US 6,486,111 B1
(45) Date of Patent: Nov. 26, 2002

(54) ANTIBACTERIAL CLEANING COMPOSITIONS IN THE FORM OF A TABLET

(75) Inventors: Steve Zabarylo, Mississauga (CA); John Fletcher, Oakville (CA); Philip Gorlin, Flemington, NJ (US); Harry Aszman, Englishtown, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/125,735

(22) Filed: Apr. 18, 2002

(51) Int. Cl.[7] ..... C11D 17/00

(52) U.S. Cl. ..... 510/314; 510/440; 510/446; 510/447; 510/477; 510/481; 510/485; 510/499; 510/507; 510/508; 510/511

(58) Field of Search ..... 510/440, 446, 510/447, 477, 481, 485, 499, 314, 507, 508, 511

(56) References Cited

U.S. PATENT DOCUMENTS

| | | | | | |
|---|---|---|---|---|---|
| 5,624,892 | A | * | 4/1997 | Angevaare et al. | 510/223 |
| 5,698,506 | A | * | 12/1997 | Angevaare et al. | 510/222 |
| 5,783,539 | A | * | 7/1998 | Angevaare et al. | 510/223 |
| 2002/0028288 | A1 | * | 3/2002 | Rohrbaugh et al. | 427/327.2 |
| 2002/0045010 | A1 | * | 4/2002 | Rohrbaugh et al. | 427/327.2 |

* cited by examiner

*Primary Examiner*—Necholus Ogden
(74) *Attorney, Agent, or Firm*—Richard E. Nanfeldt

(57) ABSTRACT

A water soluble tablet comprising a cleaning composition which contains a bleach.

12 Claims, No Drawings

ANTIBACTERIAL CLEANING COMPOSITIONS IN THE FORM OF A TABLET

FIELD OF THE INVENTION

This invention relates to a concentrate of a cleaning composition containing a bleach compound in the form of a tablet which has excellent foam collapse properties and excellent antibacterial properties grease cutting properties designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. No. 4,472,291—Rosario; U.S. Pat. No. 4,540,448—Gauteer et al; U.S. Pat. No. 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; and U.S. Pat. Nos. 4,414,128 and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; nonaqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

SUMMARY OF THE INVENTION

The present invention provides a cleaning system comprising a concentrate of a cleaning composition in a tablet form which has excellent foam collapse properties, good antibacterial properties and excellent grease cutting property which, when dissolved in a bucket, is suitable for cleaning hard surfaces such as plastic, vitreous and metal surfaces having a shiny finish, oil stained floors, automotive engines and other engines. More particularly, the improved cleaning compositions, with excellent foam collapse properties and excellent grease cutting property exhibit good grease soil removal properties due to the improved interfacial tensions, when used diluted and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products.

Surprisingly, these desirable results are accomplished even in the absence of polyphosphate or other inorganic or organic detergent builder salts and also in the complete absence or substantially complete absence of grease-removal solvent.

This invention relates to all purpose cleaning detergents in tablet form which quickly dissolve to give a cleaning solution suitable for a variety of household light duty cleaning chores such as in the kitchen or bathroom, etc. The tablet contains a bleach compound and an effervescent system consisting of an organic acid and sodium bicarbonate to give an efficacy signal while dissolving. In addition, the tablet can also optionally contain two polymeric disintegrants which help disintegrate the tablet when added to water. The tablets can be made either as a single layer tablet with colored speckles for aesthetic benefits or can be a multi-layer tablet with different colored layers.

In one aspect, the invention generally provides a single or multi layer tablet which comprises approximately by weight:

(a) 40% to 60% of an alpha hydroxy aliphatic acid such as lactic acid or citric acid;

(b) 20% to 30% of an alkali metal bicarbonate such as sodium bicarbonate or potassium bicarbonate;

(c) 2% to 8% of a magnesium containing inorganic salt selected from the group consisting of magnesium sulfate, magnesium oxide and magnesium chloride and mixtures thereof.

(d) 1% to 9% of a clay;

(e) 1% to 10% of a sulfonated anionic surfactant;

(f) 0.1% to 4% of an alkali metal salt of a polycarboxylic acid;

(g) 0.1% to 4% of a solubilizing agent;

(h) 0.5% to 1% of an alkali metal or an alkaline earth metal salt of a fatty acid such as magnesium stearate;

(i) 0 to 5%, more preferably 0.1% to 3% of an ethoxylated nonionic surfactant;

(j) 0 to 5%, more preferably 0.1% to 4% of a green colored citric acid in the form of speckles such as green speckles;

(k) 0 to 5%, more preferably 0.1% to 4% of a blue colored citric acid in the form of speckles such as blue speckles;

(l) 1% to 20% of a bleach compound; and (m) 0 to 2.5%, more preferably 0.1% to 2% of a perfume.

In another aspect, the invention generally provides a single or multi layer tablet which comprises approximately by weight:

(a) 20% to 50% of an alpha hydroxy aliphatic acid such as lactic acid or citric acid;

(b) 25% to 45% of an alkali metal bicarbonate such as sodium bicarbonate or potassium bicarbonate;

(c) 1% to 15% of an alkali metal carbonate such as potassium and/or sodium carbonate and mixtures thereof.

(d) 1% to 9% of a clay;

(e) 1% to 10% of a sulfonated anionic surfactant;

(f) 2% to 12% of a $C_4$–$C_{12}$ aliphatic dicarboxylic acid such as adipic acid;

(g) 0.1% to 6%, more preferably 0.25% to 4% of an amorphous precipitated silica;

(h) 0 to 5% of a blue or green colorant;

(i) 0 to 6%, more preferably 0.1% to 4% of a sodium sulfate; and (j) 1% of 20% of a bleach compound; and (k) 0 to 2.5%, more preferably 0.1% to 2% of a perfume.

DETAILED DESCRIPTION OF THE INVENTION

The present invention relates to a tablet containing a unit dose of a cleaning composition.

One liquid cleaning composition contained in the form of a single or multi-layered tablet comprises approximately by weight:

(a) 40% to 60% of an alpha hydroxy aliphatic acid such as lactic acid or citric acid;

(b) 20% to 30% of an alkali metal bicarbonate such as sodium bicarbonate or potassium bicarbonate;

(c) 2% to 8% of a magnesium containing inorganic salt selected from the group consisting of magnesium sulfate, magnesium oxide and magnesium chloride and mixtures thereof.

(d) 1% to 9% of a clay;

(e) 1% to 10% of a sulfonated anionic surfactant;

(f) 0.1% to 4% of an alkali metal salt of a polycarboxylic acid;

(g) 0.1% to 4% of a solubilizing agent;

(h) 0.5% to 1% of an alkali metal or an alkaline earth metal salt of a fatty acid such as magnesium stearate;

(i) 0 to 5%, more preferably 0.1% to 3% of an ethoxylated nonionic surfactant;

(j) 0 to 5%, more preferably 0.1% to 4% of a green colored citric acid in the form of speckles;

(k) 0 to 5%, more preferably 0.1% to 4% of a blue colored citric acid in the form of speckles;

(l) 1% to 20% of a bleach compound; and (m) 0 to 5.0%, more preferably 0.1% to 4% of a perfume.

Another liquid cleaning composition contained in the form of a single or multi-layered tablet comprises approximately by weight:

(a) 20% to 50% of an alpha hydroxy aliphatic acid such as lactic acid or citric acid;

(b) 25% to 45% of an alkali metal bicarbonate such as sodium bicarbonate or potassium bicarbonate;

(c) 1% to 15% of an alkali metal carbonate such as potassium and/or sodium carbonate;

(d) 1% to 9% of a clay;

(e) 1% to 10% of a sulfonated anionic surfactant;

(f) 2% to 12% of a $C_4$–$C_{12}$ aliphatic dicarboxylic acid such as adipic acid;

(g) 0.1% to 6%, more preferably 0.25% to 4% of an amorphous precipitated silica;

(h) 0 to 0.5% of a blue or green colorant;

(i) 0 to 6%, more preferably 0.1% to 4% of a sodium sulfate;

(j) 1% to 20% of a bleach compound; and (k) 0 to 5.0%, more preferably 0.1% to 4% of a perfume.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The nonionic surfactant which can be used in the instant cleaning composition is selected from the group of an aliphatic ethoxylated nonionic surfactant and an aliphatic ethoxylated/propoxylated nonionic surfactant and mixtures thereof.

The water soluble aliphatic ethoxylated nonionic surfactants utilized in this invention are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class includes the condensation products of a higher alcohol (e.g., an alkanol containing about 8 to 16 carbon atoms in a straight or branched chain configuration) condensed with about 4 to 20 moles of ethylene oxide, for example, lauryl or myristyl alcohol condensed with about 16 moles of ethylene oxide (EO), tridecanol condensed with about 6 to 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 4 to 10 moles of ethylene oxide (Neodol 91-8 or Neodol 91-5), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 7 contain less than 4 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

One of the water soluble nonionic surfactants which can be utilized in this invention are an aliphatic ethoxylated/propoxylated nonionic surfactants which are depicted by the formula:

$$RO(CH_2CH_2O)_x(CH_2CH_2CH_2O)_yH$$

or $$R\ O\ (CH_2CH_2O)_x\ (CH_2\overset{CH_3}{C}HO)_y\ H$$

wherein R is a branched chain alkyl group having about 10 to about 16 carbon atoms, preferably an isotridecyl group and x and y are independently numbered from 1 to 20.

Suitable water-soluble non-soap, anionic surfactants used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants for use in the instant compositions are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735, 096.

The clays which used in the instant compositions are the inorganic, colloid-forming clays of smectite and/or attapulgite types. These materials are generally used in amounts of about 0.5 wt. % to 10 wt. %, preferably 1 to 9 wt. %.

Smectite clays include montmorillomite (bentonite), hectorite, smectite, saponite, and the like. Montmorillonite clays are available under tradenames such as Thixogel (Registered trademark) No. 1 and Gelwhite (Registered trademark) GP, H, etc., from Georgia Kaolin Company; and ECCAGUM (Registered trademark) GP, H, etc., from Luthern Clay Products. Attapuligite clays include the materials commercially available under the tradename Attagel (Registered trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. Another clay is a bentonite clay containing a blue, green or pink dye which is manufactured by Larivosa Chimica Mineraria, S.p.A. and manufactured under the name of Detercal P4™. A most preferred clay is laponite RD clay manufactured by Southern Clay.

A bleach compound may be employed in the compositions of this invention, preferred bleach compounds are chlorine bleach compounds such as dichloroisocyanurate, dichloro-dimethyl hydantoin, or chlorinated TSP, alkali metal or akaline earth metal, e.g. potassium, lithium, magnesium and especially sodium, hypochlorite is preferred.

The alkali metal salt of the polyacrylic acid crosslinked polyacrylic acid polymer which has the structure of:

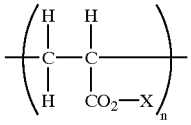

wherein n is a number sufficient to provide a polymer with a molecular weight of about 400,000 to about 2,000,000, more preferably about 400,000 to about 1,500,000 and X is an alkali metal or alkaline earth metal cation. A preferred crosslinked polyacrylic acid polymer is Acusol 771™ manufactured by the Rohm and Haas Company.

The solubilizing agent enhances the solubility of the tablet in the water during when added to water. The solubilizing agent is a crosslinked N-2-polyvinyl pyrrolidone having a particle size of 15 to 125 microns. The polyvinyl pyrrolidone is manufactured by International Speciality Corp. under the tradename Polyplasdone™ XL (100 microns) or polyplasdone™ XL-10 (30 microns).

The lubricant used in the cleaning tablet is used to improve the process for manufacturing the tablet by improving the release of the tablet from the mold during the manufacture. The lubricant is an alkali metal salt of a fatty acid having 8 to 22 carbon atoms such as sodium stearate magnesium stearate or potassium stearate and is used at a concentration of 0.05 to 2 wt. %, more preferably 0.1 to 1.0 wt. %.

The instant tablets can also contain 0 to 5.0 wt. %, more preferably 0.1% to 4% by weight of a fragrance. The instant compositions can optionally contain 0 to 15 wt. % of a lipase, protease or amylase enzyme and mixtures thereof.

The cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight. In final form, the cleaning compositions which contain less than 5 wt. % of water exhibit stability at reduced and increased temperatures.

The process for making the tablets contain two steps. Dry blending of formula amounts of powders with an overspray of the liquid nonionic and fragrance. Any needed color solutions are also sprayed at this time and then running the resulting powder through a tablet press which has molds to prepare tablets of desired shape, size and weight. The powders are added to the mixer (twin shell or other appropriate mixer).

The powder is then fed to a rotary press having from 19 to 30 molds. Tablets are pressed at a high speed (5 per second). As they exit the press, they are channeled to the packaging line. The tablets can be generally any shape but preferably elliptical in shape or the tablets can be elongated in shape with curved ends such as an oval shape or even circular, square or rectangular.

The following examples illustrate liquid cleaning compositions of the described 15 invention. Unless otherwise specified, the proportions in the film and elsewhere in the specification are by weight.

EXAMPLE 1

The following formula was prepared in wt. % by simple mixing and then formed into a tablet:

| | |
|---|---|
| Sodium dichloroisocyanurate dihydrate | 10.00 |
| Sodium bicarbonate - granular | 32.20 |
| Sodium carbonate - anhydrous | 7.00 |
| Sodium dodecyl benzene sulfonate - 85% Al | 5.00 |
| Anhydrous citric acid - granular | 31.25 |
| Adipic acid | 7.50 |
| Cl pigment blue 15:1 (Cl74160) | 0.05 |
| White bentonite clay powder No. 2 | 5.00 |
| Synthetic amorphous precipitated silica | 0.75 |

The tablet containing the above formulas were dissolved in three minutes in 2 L of water in a vessel. This formula generates foam during dissolution and subsequent use.

What is claimed:

1. An antibacterial cleaning tablet which comprises approximately by weight:

(a) 40% to 60% of an alpha hydroxy aliphatic acid;

(b) 20% to 30% of an alkali metal bicarbonate;

(c) 2% to 8% of a magnesium containing inorganic salt;

(d) 1% to 9% of laponite clay;

(e) 1% to 10% of a sulfonated anionic surfactant;

(f) 0.1% to 4% of an alkali metal salt of a polycarboxylic acid;

(g) 0.1% to 4% of a solubilizing agent;

(h) 1% to 20% of a dichloroisocyanurate bleach compound; and (i) 0.5% to 1% of an alkali metal or an alkaline earth metal salt of a fatty acid such as magnesium stearate.

2. A cleaning tablet according to claim 1 further including a nonionic surfactant.

3. A cleaning tablet according to claim 2 wherein said solubilizing agent is a polyvinyl pyrrolidone.

4. A cleaning tablet according to claim 1 further including a perfume.

5. A cleaning tablet according to claim 4 further including blue colored speckles of citric acid and/or green colored speckles of citric acid.

6. A cleaning tablet according to claim 1 further including blue colored speckles of citric acid and/or green colored speckles of citric acid.

7. A cleaning tablet according to claim 1, wherein said tablet is a single layer.

8. A cleaning tablet according to claim 1, wherein said tablet comprises multi-layers.

9. An antibacterial cleaning tablet which comprises approximately by weight:

(a) 20% to 50% of an alpha hydroxy aliphatic acid;

(b) 25% to 45% of an alkali metal bicarbonate;

(c) 1% to 15% of an alkali metal carbonate;

(d) 1% to 9% of a laponite clay;

(e) 1% to 10% of a sulfonated anionic surfactant;

(f) 2% to 12% of a $C_4$–$C_{12}$ aliphatic dicarboxylic acid;

(g) 1% to 20% of a dichloroisocyanurate bleach compound; and (h) 0.1% to 6% of an amorphous precipitated silica.

10. A cleaning tablet according to claim 9 further including a perfume.

11. A cleaning tablet according to claim 9, wherein said tablet is a single layer.

12. A cleaning tablet according to claim 9, wherein said tablet comprises multi-layers.

* * * * *